United States Patent [19]

Stanton

[11] Patent Number: 4,490,866

[45] Date of Patent: Jan. 1, 1985

[54] SYSTEM FOR MOUNTING A MATTRESS COVER TO A MATTRESS CORE

[75] Inventor: Norman C. Stanton, Portland, Oreg.

[73] Assignee: Tualatin Sleep Products, Inc., Tualatin, Oreg.

[21] Appl. No.: 447,240

[22] Filed: Dec. 6, 1982

[51] Int. Cl.[3] ..... A47C 23/00

[52] U.S. Cl. ..... 5/471; 29/432.1

[58] Field of Search ..... 5/470, 471, 472, 466, 5/467, 475, 448, 259 B, 259 R, 478, 464, 267; 29/432.1

[56] References Cited

U.S. PATENT DOCUMENTS

| | | | |
|---|---|---|---|
| 932,024 | 8/1909 | Kalas et al. | 5/475 |
| 1,375,061 | 4/1921 | Nyhus . | |
| 1,699,910 | 1/1929 | Opsahl . | |
| 1,882,538 | 10/1932 | Wunderlich | 5/193 |
| 1,892,913 | 1/1933 | Timm . | |
| 1,906,686 | 5/1933 | Will et al. | 5/478 |
| 2,074,399 | 3/1937 | Karr . | |
| 2,154,910 | 4/1939 | Magaril . | |
| 2,217,955 | 10/1940 | Kay . | |
| 2,399,628 | 5/1946 | Cunningham | 5/467 |
| 2,513,582 | 7/1950 | Nattenheimer | 5/467 |
| 3,950,800 | 4/1976 | Garshfield . | |
| 4,080,675 | 3/1978 | Kanowsky et al. | 5/472 |

*Primary Examiner*—Alexander Grosz
*Assistant Examiner*—Vinh Luong
*Attorney, Agent, or Firm*—Klarquist, Sparkman, Campbell, Leigh & Whinston

[57] ABSTRACT

A system for mounting a mattress cover to a mattress core is provided. The mattress cover to be mounted typically has top, bottom, and skirt portions with a closable opening adjacent the skirt portion. The system includes a web mounted to and extending along a portion of the side periphery of the mattress core, and a freely positionable fastener having an enlarged head and a pointed extension member for piercing the mattress cover skirt portion and the web to fix the position of the mattress cover with respect to the web and the mattress core.

6 Claims, 3 Drawing Figures

SYSTEM FOR MOUNTING A MATTRESS COVER TO A MATTRESS CORE

BACKGROUND OF THE INVENTION

1. Field of the Invention

This invention relates generally to mattresses and more particularly to a system and method for mounting a mattress cover to a mattress core.

2. Discussion of the Prior Art

For many years mattresses were constructed and assembled at factory locations by skilled personnel using specially designed equipment. When the inner components of the mattress had to be repaired or replaced, the mattress was shipped back to the factory where such work was performed. This was inconvenient because provision had to be made to do without the mattresses being renovated and could also be expensive for commercial applications such as hotels, hospitals, and the like where replacement mattresses had to be provided or the room could not be used. Another drawback with factory renovation is that a substantial proportion of the cost of renovation was absorbed by the shipment costs because mattresses are bulky and are subject to damage when stacked or otherwise improperly loaded. The work at the factory is expensive because it required skilled personnel using specialized equipment often taken off the mattress construction workline.

Many attempts have been made to eliminate the need for returning mattresses to the factory for renovation and repair. For example, U.S. Pat. No. 1,882,538 to Wunderlich discloses a mattress cover which is zipped around and fastened to the mattress core utilizing a plurality of spaced, pre-positioned fasteners. While the use of this mattress and other similar mattresses often permitted a certain amount of renovation and repair to be performed on site by unskilled personnel, the provision of such pre-positioned fasteners was expensive and necessarily limited the versatility of the fastening system because the positioning and number of fasteners was predetermined without consideration being given to the intended usage conditions of a particular mattress. Also, in actually assembling Wunderlich's mattress, the mattress cover and mattress core had to be perfectly aligned, often complicating the mattress assembly procedure and possibly requiring that skilled personnel or specialized tools be utilized.

U.S. Pat. No. 1,375,061 to Nyhus utilizes a button-like, pronged fastener which, in combination with a pair of flat washers, is used to affix a mattress spring to upper and lower mattress core panels. However, Nyhus does not disclose that this fastener may be usable to mount a mattress cover to a mattress core.

Another prior art attempt to solve the above problems is disclosed in U.S. Pat. No. 3,950,800 to Garshfield. This patent discloses a mattress having two flanged mattress cover halves which are zipped to one another to encompass the mattress core. While this mattress may permit assembly by unskilled personnel and without requiring the use of specialized equipment, Garshfield's system necessitates the use of a specially designed mattress cover having mattress flanges which can add dramatically to the cost. Moreover, Garshfield's mattress cover is not actually affixed to the mattress core, but only encompasses the core. Therefore, it is possible that a certain amount of sliding would take place between the mattress cover and the core, particularly during shipment, which can result in damage to the mattress cover.

Hence, it is a primary object of the present invention to provide an improved mattress cover mounting system which effectively and reliably overcomes the aforementioned limitations and drawbacks of the prior art proposals. More specifically, the present invention has as its objects one or more of the following taken individually or in combination:

(1) The provision of a system for mounting a mattress cover to a mattress which permits the mattress cover to be mounted to and removed from the mattress core by unskilled personnel, on site, without having to use specially designed equipment;

(2) To develop a method for mounting a mattress cover to a mattress core which does not require the use of pre-positioned fasteners which can be expensive and which can complicate the assembly procedure;

(3) To provide a mattress cover mounting system in which a conventionally designed mattress cover may be mounted to the mattress core; and (4) The provision of a system for mounting a mattress cover to a mattress core in which the mattress cover is affixed to the mattress core so that no relative movement takes place between the cover and the core.

SUMMARY OF THE INVENTION

This invention responds to the problems presented in the prior art by providing a system for mounting a mattress cover having top, bottom, and skirt portions, and a closable opening adjacent the skirt portion, to a mattress core. The type of mattress cover to which the invention applies is to be an integral part of the assembled mattress and is not a slip-type cover which simply fits over a mattress.

The system includes at least one web mounted to and extending along a portion of the side periphery of the mattress core, freely positionable fastening means having an enlarged head and a pointed extension member for piercing the mattress cover skirt portion and the web to fix the position of the mattress cover with respect to the web. The term "web" as used herein means a flat, sheet-like member typically but not necessarily made of fabric. Typically, a plurality of spaced webs are provided, each of the webs extending from an upper to a lower portion of the side periphery of the mattress core. In such embodiment, an independent fastening means is provided for each such web.

The method of the invention includes the steps of inserting a freely positionable button having an enlarged head and a splittable, pointed extension member, through the mattress cover skirt portion and the web disposed therebehind, directing the button extension member through a freely positionable ring by reaching in through the mattress opening to obtain access and separating the extension member. Thus, the ring, the web, and the mattress cover skirt portion are all fixed with respect to each other and with respect to the button.

The invention thus provides a system from mounting a mattress cover to a mattress core which is inexpensive, which may be practiced by unskilled personnel, on site, without requiring use of specialized equipment, and which can be used to mount a conventionally designed mattress cover.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Construction of the Depicted Embodiment

Figure 1:
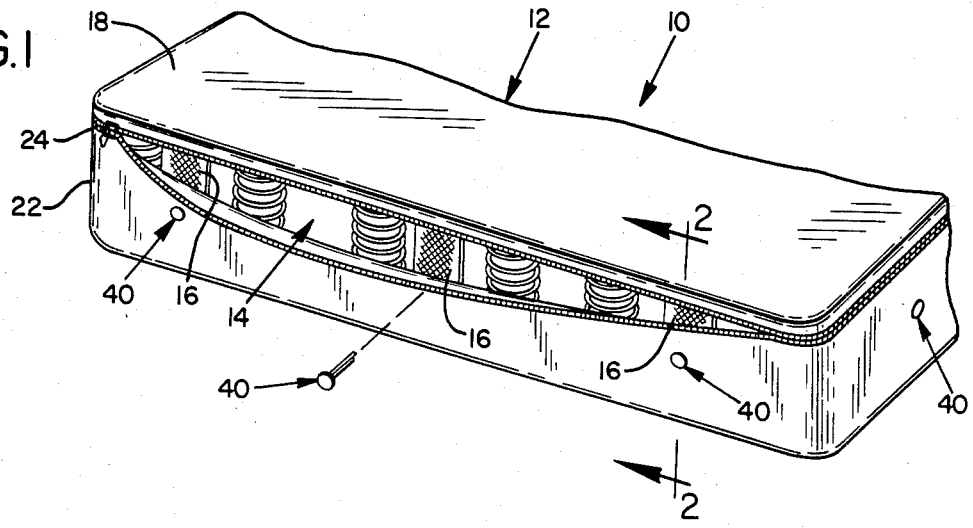
FIG. 1 is a fragmentary perspective view of one embodiment of the present invention, showing the mattress cover partially zipped open at one end to show the webs, and with one of the mounting buttons removed.
Figure 2:
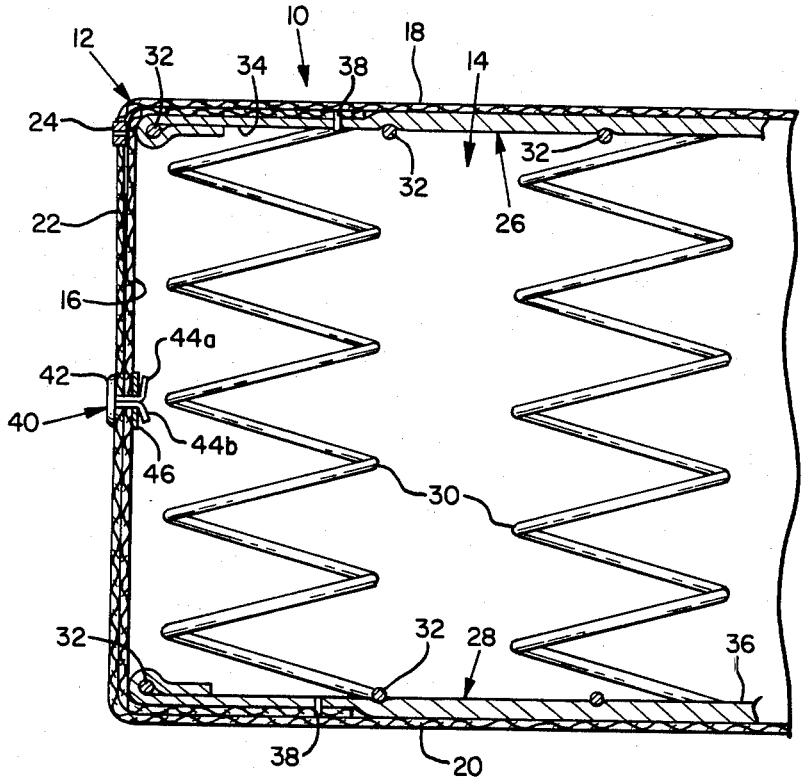
FIG. 2 is a side elevation sectional view taken along line 2—2 of FIG. 1.

The principles of this invention are particularly useful when embodied in a mattress such as that depicted in FIGS. 1 and 2 and generally identified with the numeral 10. Mattress 10 is comprised essentially of a mattress cover 12, a mattress core 14, and a plurality of spaced webs 16 mounted to the periphery of the mattress core.

Mattress cover 12 is of conventional design and includes a top portion 18, a bottom portion 20, and a skirt portion 22. Mattress cover 12 may be opened to obtain access into mattress core 14 by a zipper 24, or other conventional means. In the depicted embodiment, zipper 24 is shown to be disposed in the skirt portion 22 but adjacent the intersection of the skirt and top portions. The location of zipper 24 in mattress cover 12 is not critical, and one advantage of the present invention is that it is usable with a wide variety of conventional mattress cover designs.

Mattress core 14 is also of conventional design, and another advantage of the present invention is that it may be used with a wide variety of mattress core designs. The depicted mattress core 14 includes upper and lower frame members, indicated generally at 26 and 28, respectively, with a plurality of springs 30 extending therebetween. Upper and lower frame members 26 and 28 include rigid, transversely extending support members 32 which extend from side-to-side of the mattress. Also included, but not appearing in the figures, are longitudinally extending support members between which transverse support members 32 extend. Upper and lower internal mattress pads 34 and 36 are mounted to the upper and lower frame members 26 and 28, respectively, to cushion support members 32. Mattress pads 34 and 36 are also of conventional design and are normally fabricated of a rag-like composite material.

As mentioned above, springs 30 extend between upper and lower frame members 26 and 28 to provide a high degree of resiliency to mattress core 14. However, a wide variety of other resilient designs might be substituted for the springs of the depicted embodiment. For example, in some mattresses foam rubber or the like is provided in place of or in combination with springs 30.

In the depicted embodiment, webs 16 extend between upper and lower frame members 26 and 28. As shown in FIG. 2, webs 16 are fastened by staples 38 to upper and lower mattress pads 34 and 36, although other suitable fastening means may be utilized. As shown in FIG. 1, webs 16 are evenly spaced along the periphery of mattress core 14 to permit access into mattress core 14 when mattress cover zipper 24 is opened. This, in turn, permits access to the mattress cover fastening means which will now be described.

Figure 3:
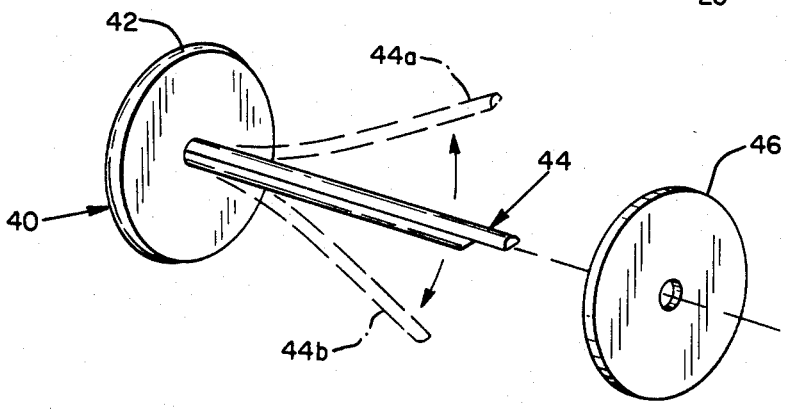
FIG. 3 is an enlarged view of fastening means which may be used with the embodiments of FIGS. 1 and 2, showing a washer which may be used with a button and illustrating in phantom how extension members of the button are split after the washer has been slid into place over the extension member.

In the preferred embodiment, the mattress cover fastening means includes a button, indicated generally at 40 and shown best in FIG. 3. Button 40 includes an enlarged head 42, with a pointed, splittable extension member 44 comprised of extension member halves 44*a* and 44*b*. A flat washer 46 is also provided which is slidable onto button extension member 44 when the extension member halves 44*a* and 44*b* are in their original, nonsplit disposition depicted in solid lines in FIG. 3. Once washer 46 has been slid onto extension member 44, the extension member halves 44*a* and 44*b* are split as depicted in phantom in FIG. 3 and in section in FIG. 2 to securely fasten the washer to the button.

Operation of the Depicted Embodiment

To assemble mattress 10 using the depicted mattress cover fastening system, webs 16 are first mounted to mattress core 14. Once this is done, zipper 24 is opened so that mattress cover 12 can be slid over mattress core 14. With zipper 24 still open, an extension member 44 of a button 40 is pierced through the skirt portion 22 of mattress cover 12 in alignment with a web 16. The extension member is then also pierced through web 16, and a washer 46 is slid over the extension member 44 from the opposite side of the web. The halves 44*a* and 44*b* of extension member 44 are then split and bent down over washer 46 as depicted in FIG. 2, thus securely fastening the washer to button 40 and affixing mattress cover 12 to web 16 and mattress core 14 to which the web is mounted.

This process is repeated for as many buttons as are necessary. There may be a button provided for each web or merely one button per side may be utilized. When all the desired buttons have been mounted in place, zipper 24 is closed, thereby completing assembly of the mattress 10.

In the event repair work has to be performed on the core 14 of mattress 10, zipper 24 is opened; extension member halves 44*a* and 44*b* of each of the buttons are bent back to their original position depicted in solid lines in FIG. 3; washer 46 is removed; and the button is pulled out of mattress cover 12. This is repeated for each of the buttons. Zipper 24 is then fully opened, and mattress cover 12 is removed from mattress core 14. Once the work is completed on mattress core 14, mattress cover 12 may be remounted to the mattress core and the same buttons may be used to affix it in place.

While the depicted embodiment shows webs 16 which extend between upper and lower frame members 26 and 28, it should be appreciated that other web configurations may be desirable in certain applications. For example, the web might extend all the way around the sides of mattress core 14, with hand openings merely being provided therein to reach around to position washer 46 in place. In another embodiment, the web might extend in a direction substantially parallel to upper and lower frame members 26 and 28, being affixed to the springs or other portions of mattress core 14. In this latter embodiment, the operator can reach above or below the web to mount the washer in place. Neither of the embodiments of this paragraph involves covering the entire side periphery of the mattress core. Therefore, they are intended to be encompassed by the language defining the web to be extending "along a portion of the side periphery of the mattress core."

Of course, it should be understood that other modifications of the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. A system for mounting a mattress cover having top, bottom, and skirt portions, and a closable opening adjacent the skirt portion, to a mattress having a mattress core, comprising:

a plurality of spaced apart planar webs mounted to and extending along a portion of the side periphery of the mattress core, each said web connecting upper and lower portions of said mattress core; and freely positionable fastening means, associated with each said web, having an enlarged head and a pointed extension member piercing the mattress cover skirt portion and said web, and a freely positionable engagement member engaging each said extension member, said extension member at the inner side of said web being in contact therewith to fix the position of the mattress cover with respect to said web and the mattress core to which said web is mounted.

2. The system of claim 1 wherein said pointed extension member of each of said fastening means comprises a splittable pin and each of said engagement members comprises a ring, so that once said splittable pin has been threaded through said ring, said splittable pin is split and spread apart, thereby affixing said ring to said enlarged head.

3. A mattress comprising:

a mattress core having springs and a plurality of flat sheet-like spaced apart webs extending from an upper to a lower portion of the side periphery of said mattress core between said portions;

a mattress cover having top, bottom, and skirt portions; and freely positionable fastening means for each said web, having an enlarged head and pointed extension member piercing the mattress cover skirt portion and said web, and for affixing said mattress cover to said web and said mattress core.

4. The mattress of claim 3, wherein each of said fastening means further comprises a freely positionable, ring-like engagement member for engaging said extension member at the inner side of said web.

5. A method for mounting a mattress cover having top, bottom, and skirt portions, and a closable opening adjacent the skirt portion, to a mattress core having springs and a plurality of flat sheet-like spaced apart webs extending from an upper to a lower portion of the side periphery of the mattress core between said portions, comprising:

inserting a freely positionable button having an enlarged head and a splittable, pointed extension member, through the mattress cover skirt portion and the web disposed therebehind;

directing the button extension member through a freely positionable ring by reaching in through the opening in the mattress cover to obtain access thereto; and splitting and separating the extension member so that the ring, the web, and the mattress cover skirt portion are all fixed with respect to each other and with respect to the button.

6. A mattress comprising:

a mattress core;

a plurality of flat spaced apart webs connecting upper and lower portions of said mattress core;

a mattress cover having top, bottom, and skirt portions; and freely positionable fastening means for each said web, having an enlarged head and pointed extension member piercing the mattress cover skirt portion and said web, and a freely positionable engagement member associated with each said fastening means to engage said extension member at an inner surface of said web and in contact therewith to fix the position of the mattress cover with respect to said web.

* * * * *